US007086365B1

(12) United States Patent
Teeter

(10) Patent No.: US 7,086,365 B1
(45) Date of Patent: Aug. 8, 2006

(54) AIR INTAKE MANIFOLD

(76) Inventor: Darrin Blake Teeter, 3154 N. Wild Rose, Wichita, KS (US) 67205

( * ) Notice: Subject to any disclaimer, the term of this patent is extended or adjusted under 35 U.S.C. 154(b) by 0 days.

(21) Appl. No.: 11/082,443

(22) Filed: Mar. 17, 2005

Related U.S. Application Data

(60) Provisional application No. 60/553,927, filed on Mar. 17, 2004.

(51) Int. Cl.
*F02M 35/104* (2006.01)

(52) U.S. Cl. ..... 123/184.21; 123/184.61

(58) Field of Classification Search ..... 123/184.21, 123/184.61, 184.53, 184.57; 181/214, 229
See application file for complete search history.

(56) References Cited

U.S. PATENT DOCUMENTS

| | | | | |
|---|---|---|---|---|
| 2,755,216 | A | 7/1956 | Lemons | |
| 3,750,355 | A | 8/1973 | Blum | |
| 4,155,970 | A | 5/1979 | Cassell | |
| 4,248,817 | A | 2/1981 | Frank | |
| 5,176,864 | A | 1/1993 | Bates et al. | |
| 5,242,735 | A | 9/1993 | Blankenburg et al. | |
| 5,348,798 | A | 9/1994 | Berghuis et al. | |
| 5,364,491 | A | 11/1994 | Aochi et al. | |
| 5,435,226 | A | 7/1995 | McQuilkin | |
| 5,474,632 | A | 12/1995 | Ray et al. | |
| 5,609,942 | A | 3/1997 | Ray | |
| 5,654,518 | A | 8/1997 | Dobbs | |
| 5,866,235 | A | 2/1999 | Fredrick et al. | |
| 5,992,369 | A * | 11/1999 | Mehne | 123/184.21 |
| 6,036,470 | A | 3/2000 | Basso, Jr. et al. | |
| 6,050,523 | A | 4/2000 | Kraenzien | |
| 6,051,089 | A | 4/2000 | Palmer et al. | |
| 6,203,749 | B1 | 3/2001 | Loving | |
| 6,553,953 | B1 * | 4/2003 | Fujihara et al. | 123/184.21 |

* cited by examiner

*Primary Examiner*—Willis R. Wolfe
*Assistant Examiner*—Hyder Ali

(57) ABSTRACT

A composite air intake manifold includes a header and runners having communicating passages. The composite intake manifold is fashioned from carbon fiber cloth which is preferably impregnated with resin and cured between a meltable core mold and a split outside mold. The carbon fiber cloth is oriented throughout the manifold to give the manifold maximum pressure resisting capability with minimum thickness and weight. Because virtually any shape may be adopted for the interior passages of the header and the runners, the interior passages of the header and runners may be shaped to enhance air flow through the manifold.

14 Claims, 4 Drawing Sheets

AIR INTAKE MANIFOLD

CROSS REFERENCE TO RELATED APPLICATION

This application claims the benefit of U.S. provisional application 60/553,927 filed Mar. 17, 2004.

FIELD OF THE INVENTION

This invention relates to a lightweight, composite air intake manifold for internal combustion engines and a method for making it.

BACKGROUND OF THE INVENTION

A need exists for lightweight intake manifolds for internal combustion engines capable of withstanding significant internal pressures. Many prior art intake manifolds have been fashioned from cast aluminum which, for a typical four cylinder internal combustion engine, may weigh approximately 15 pounds and may act to heat the intake air charge, adversely affecting performance. Moreover, there is a need for internal combustion engine intake manifolds having internal passages shaped and sized for efficient air flow. What is needed is a lightweight, high strength, low thermal mass intake manifold having internal passage geometry adapted to facilitate air flow and a method for making such an intake manifold.

BRIEF DESCRIPTION OF THE INVENTION

In an embodiment of the present invention the aforementioned need is addressed by providing a lightweight composite air intake manifold and a method for making such a manifold which allows the manifold designer to optimize the internal passage geometry for efficient air flow. A composite air intake manifold of the present invention includes a header and runners having communicating passages. The composite intake manifold is fashioned from resin impregnated carbon fiber cloth which is preferably impregnated and cured between a meltable core mold and a split outside mold. The carbon fiber cloth is oriented throughout the manifold to give the manifold maximum pressure resisting capability with minimum thickness and weight. Because virtually any shape may be adopted for the interior passages of the header and the runners, the interior passages of the header and runners may be shaped to enhance air flow through the manifold.

The method for making the present air intake manifold preferably employs at least two complementary outside mold portions having inside surfaces corresponding to the desired outside surface of the manifold and a core mold having an outside surface corresponding to the desired inside surfaces of the internal manifold passages. The outside mold is preferably made from a durable material for repeated use. The core mold is preferably made from a meltable material such as for example a wax composition that is substantially impermeable to a thermosetting resin. It is important that the core mold material have a melting point that is above the temperature at which the thermosetting resin selected for the manifold cures and that is also below the temperature at which the selected resin begins to degrade after it has been cured.

The manifold is laid up by first placing portions of structural fiber cloth around the core mold. A spray adhesive may be used to position fiber cloth portions upon the complex curved outer surfaces of the core mold. Any appropriate fabric, such as carbon fiber fabric, fiber glass fabric or even ceramic fiber fabric may be used. The outside molds are closed around the fabric covered core mold. After the lay-up is assembled, liquid resin is transferred into the dry structural fabric through holes or channels in at least one of the outer molds. A resin and core mold material combination is selected such that the resin can be cured at a temperature below the melting point of the core mold material. After the resin is cured, the manifold is heated until the core mold material melts and drains out. As stated above, a core mold material and resin combination is selected such that the core mold material may be melted away without degrading the cured resin. A solvent may be used to wash out any remaining core mold material. Fittings for interfacing with other engine components may then be added to the manifold using appropriate adhesives. Alternatively, the fittings may be molded into the manifold if geometry permits. The resulting manifold is very light, may have excellent internal geometry for conducting air flow and may be very strong for resisting high internal pressures.

DETAILED DESCRIPTION

Figure 1A:
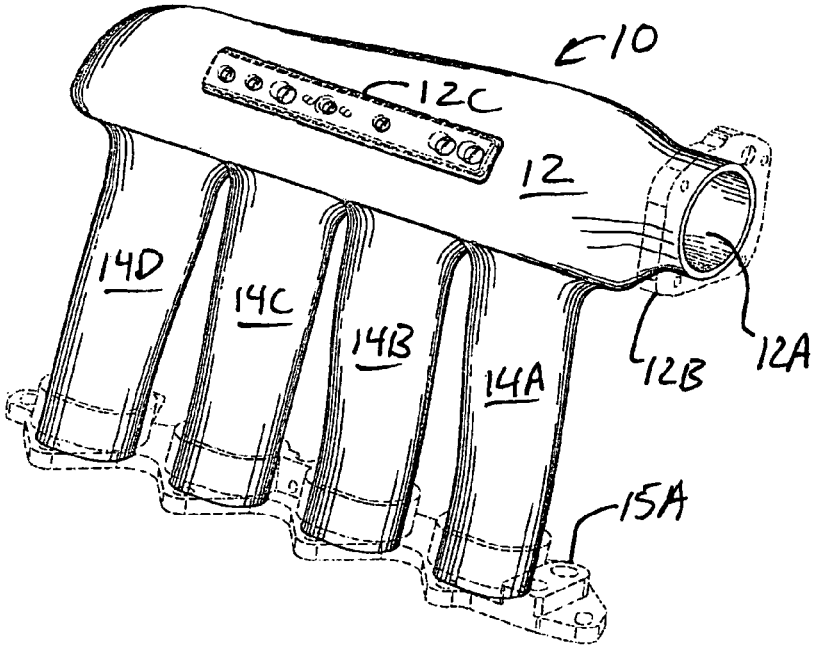
FIG. 1A is a perspective view of a composite intake manifold.
Figure 1B:
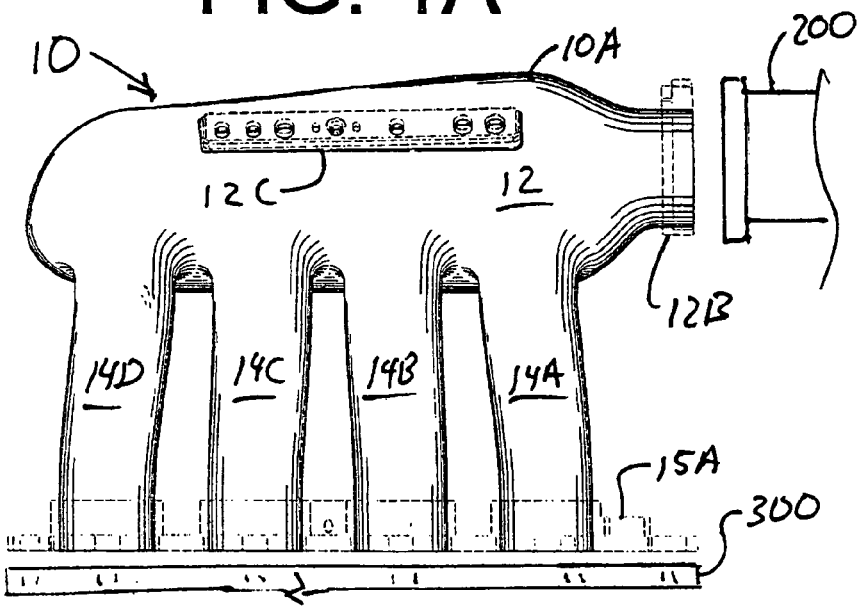
FIG. 1B is a side view of a composite intake manifold
Figure 2:
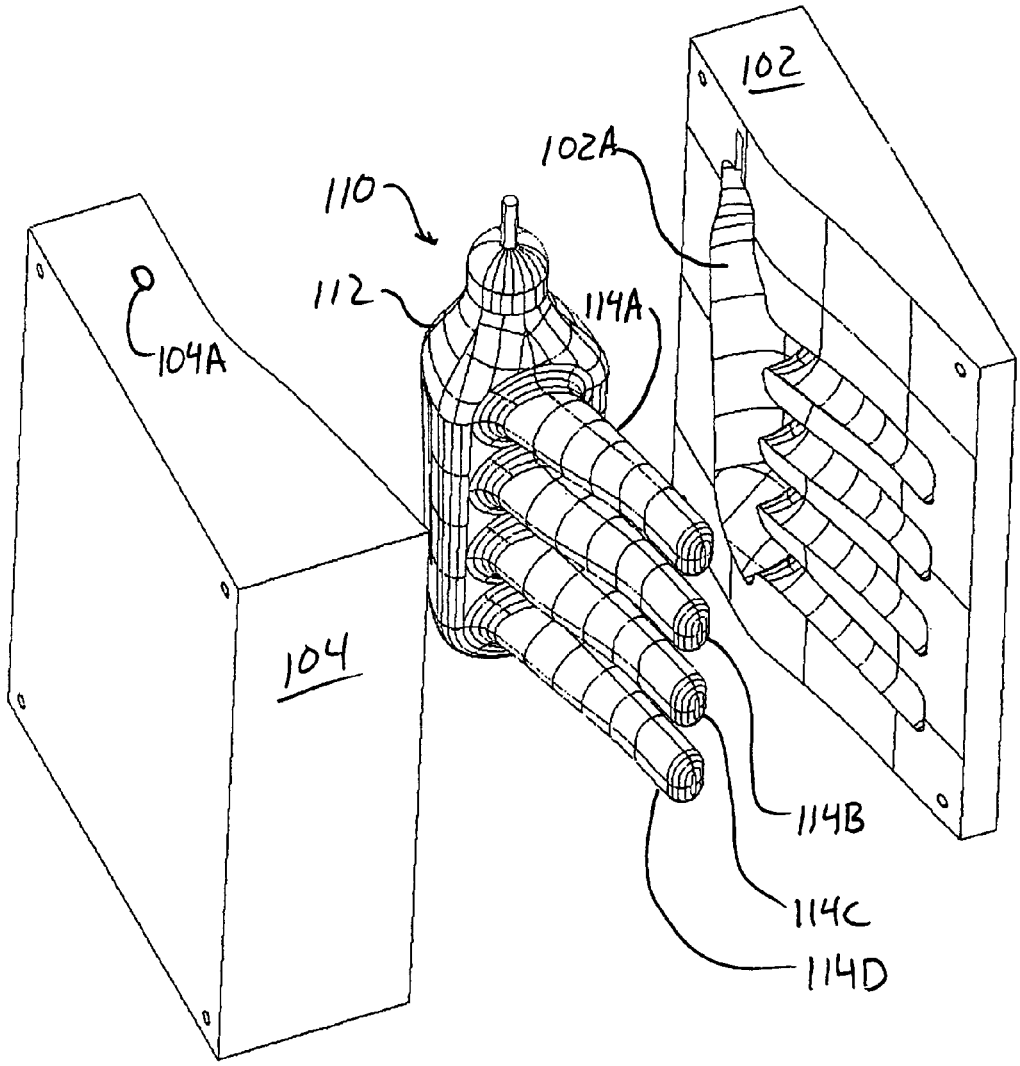
FIG. 2 is an exploded view the molds needed to lay-up a composite intake manifold body including two outer mold pieces and a core mold.

Referring to the drawings, FIGS. 1A and 1B illustrates a composite intake manifold 10. The composite intake manifold 10 includes a manifold body 10A which further includes a header 12 and, in this example, four runners 14A, 14B, 14C and 14D extending from the body of header 12. Each of runners 14A, 14B, 14C and 14D provides an outlet port. Runners 14A, 14B, 14C and 14D are bonded to an aluminum outlet fitting 15A for mating with the intake ports of the cylinders of an internal combustion engine 300 shown in FIG. 1B. Header 12 includes an inlet opening 12A around which is bonded an inlet fitting 12B for mating with the outlet fitting of an air supply 200 shown in FIG. 1B or other source of air. A second aluminum fitting 12C is also glued to header 12. Header 12 and runners 14A, 14B, 14C and 14D of intake manifold body 10A are integrally formed with resin impregnated high strength fabric. The method for fabricating intake manifold body 10A will be described in greater detail below. As can be seen in FIG. 2, intake manifold body 10A is relatively thin walled. Because intake manifold body 10A is relatively thin walled and fabricated from a high strength lightweight composite material, intake manifold 10 with bonded aluminum fittings 12B, 12C and 15A has a weight that is approximately 30% of the weight of a traditional cast aluminum intake manifold. Intake manifold body 10A may also have internal passages which may be advantageously shaped to facilitate air flow.

FIG. 2 presents an exploded isometric view of outside molds 102 and 104 as well as core mold 110 for fashioning an intake manifold body 10A. As can be seen in FIG. 2, lay-up 100 includes a first outside mold 102, a second compatible outside mold 104 and a core mold 110. First and second outside molds 102 and 104 fit together in a clam shell fashion. First and second outside molds 102 and 104 are fashioned from a durable, reusable material. First outside mold 102 includes a mold impression 102A which is offset from the outside surface of core mold 110. Similarly, second outside mold 104 includes a corresponding mold impression (not shown) which is offset from the opposite outside surface of core mold 110. The impressions of outside molds 102 and 104 define a surface that is offset from the outside surface of core mold 110. These impressions are suitable for forming the outside surface of manifold body 10A. This degree of offset is generally related to the desired thickness of manifold body 10A. Second outside mold 104 is shown in FIG. 2 to include a resin inlet port for receiving resin and conveying it to the interior impressions of mated first and second outside molds 102 and 104. Core mold 110 is preferably fashioned from an expendable wax material which will be described in greater detail below. Core mold 110 includes a header portion 112 for forming header the inside surfaces of header 12 and runner portions 114A, 114B, 114C and 114D for forming the inside surfaces of runners 14A, 14B, 14C and 14D.

Figure 3A:
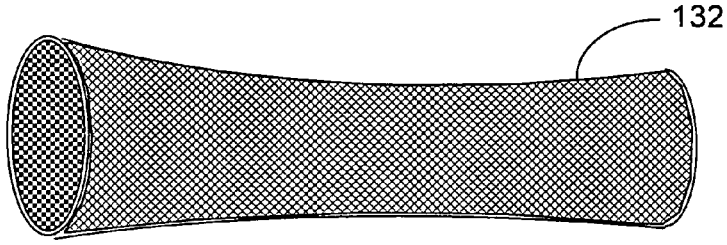
FIG. 3A is an plan view of a first fabric portion used to cover a runner.
Figure 3B:
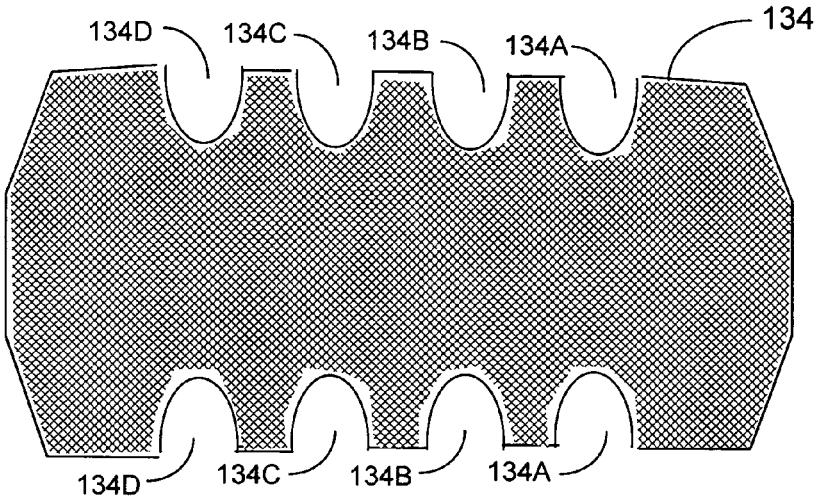
FIG. 3B is an plan view of a second fabric portion used to cover the header.
Figure 3C:
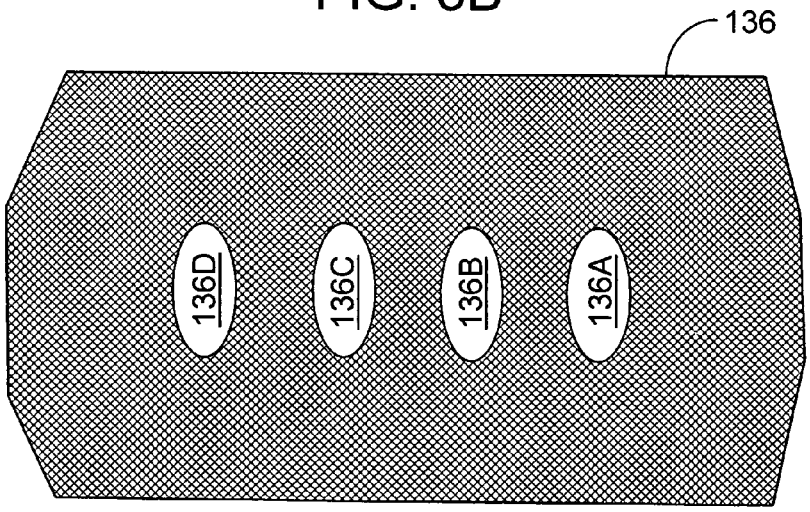
FIG. 3C is an plan view of a third fabric portion used to cover the header having edges for forming seams that are spaced away from the seams formed by the second fabric portion.
Figure 3D:
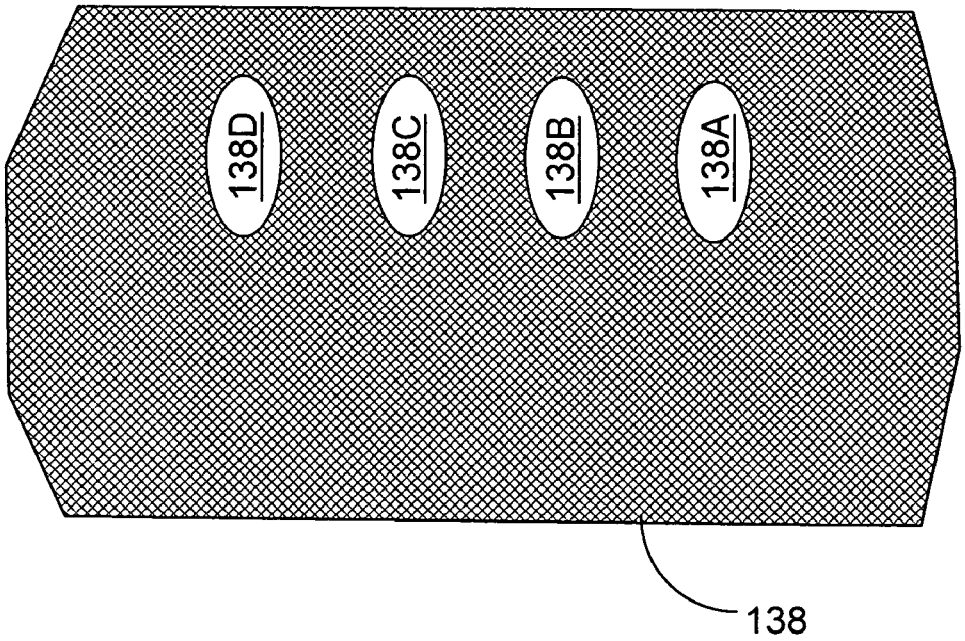
FIG. 3D is an plan view of a fourth fabric portion used to cover the header having edges for forming seams that are spaced away from the seams formed by the second and third fabric portions.

FIGS. 3A–3D illustrate first, second and third structural fabric portions 132, 134 and 136 for covering core mold 110. First structural fabric portion 132 shown in FIG. 3A is tube shaped and has a weave pattern having fibers oriented approximately 45 degrees to its central axis. This weave pattern allows for easy diametrical adjustment as a first fabric portion is placed around one of runner portions 114A, 114B, 114C and 114D. Although only one first fabric portion 132 is shown in FIG. 3A, at least four and more likely some multiple of four such first fabric portions will be used to cover of runner portions 114A, 114B, 114C and 114D. Second, third and fourth fabric portions 134, 136 and 138 shown in FIGS. 3B–3D are for covering header portion 112. Second fabric portion 134 includes corresponding edge openings 134A, 134B, 134C and 134D for clearing runner portions 114A, 114B, 114C and 114D as second fabric portion 134 is wrapped around header portion 112 of core mold 102. Similarly, third fabric portion 136 shown in FIG. 3C includes openings 136A, 1136B, 136C and 136D for receiving runner portions 114A, 114B, 114C and 114D. Fourth fabric portion 138 shown in FIG. 3D also has a series of openings 138A, 138B, 138C and 1138D for receiving runner portions 114A, 114B, 114C and 114D of core mold 110. However, the openings in fabric portion 138 have been offset so that the edges of fabric portion 138 will join at a different location on core mold 110 thus forming a seam at a different location than that formed by third fabric portion 136. With the use of such offset openings, seams may be placed in other locations around header portion 112 of core mold 110. This layering of seams with areas of fabric having no seams increases the strength of the resulting manifold body 10A. The fabric portions shown in FIGS. 3A–3C are intended to be merely examples of the types of structural fabric patterns used to lay-up manifold body 10A. The fabric portions described above may be applied in multiple plies to achieve a required capability for withstanding internal pressure.

The structural fabric portions described above may, for example, be fashioned from an aramid fiber such as du Pont KEVLAR® fiber or may, for example, be fashioned from fiber glass, carbon fiber or even ceramic fiber for advantageous thermal properties. Multiple layers of first structural fabric portions 132 may be laid up on each runner portion of core mold 110 and multiple layers of second, third and fourth fabric portions 134, 136 and 138 or other structural fabric portions having various offset opening locations for staggering the locations of seams may be laid up around core mold 110. The number and type of fabric portions would depend on the intended operating environment and conditions of manifold 10. For example, a high pressure manifold would require a larger number of layers of structural fabric. Because temperatures in an engine compartment may often exceed 150° F., a resin may be selected which is capable of resisting relatively high temperatures above 150° F. In the alternative, pre-impregnated sheets of structural cloth may be used. The resin present in such pre-impregnated cloth should have a curing temperature below the melting temperature of the core mold material and a degradation temperature above the melting temperature of the core mold material.

The process of laying up manifold body 10A can be understood by referring to FIG. 2. FIG. 2 is a perspective view showing outside molds 102 and 104 and core mold 110 used for making an intake manifold body 10A according to the method of this invention. To conduct the process for making manifold body 10A, the following components are needed: (1) a first outside mold 102, (2) a second complementary outside mold 104, (2) a core mold 110 and (3) at least four fabric portions 132 and at least a combination of fabric portions including at least two of fabric portions 134, 136 and 138. Fabric portions 132, 134, 136 and 138 may all be fashioned from a dry, unimpregnated structural fiber fabric. In the alternative, some or all of them may be fashioned from structural cloth which is pre-impregnated with resin.

The applicant has found that the best core mold material for both first core mold 110 is a wax composition that is formulated to melt at a temperature above 160° F. Those skilled in the art can formulate a wax having a desired melting point. A supplier of industrial waxes such as Calwax, Inc. of Irwindale, Calif. can easily supply a wax composition having a desired melting point. For example, a wax composition consisting of 40 parts Calwax 126™ wax, 60 parts Calwax 252B™ wax and 1 part Calwax 320™ wax obtained from Calwax, Inc. will melt above 160° F. Ceramic micro-spheres or some other similar material can be added to the core mold composition to reduce thermal expansion effects at the curing temperature of the resin, to reinforce the core material structurally and to even reduce the weight of the core material. The addition of ceramic micro-spheres also makes it possible to compose core mold materials having such favorable thermal expansion characteristics that parts with larger internal volumes can be produced while maintaining the overall shape of the part within exact tolerances. Such space filling materials would also decrease the amount of heat needed to melt a volume of core mold wax. It is generally advantageous to reduce the thermal expansion effects associated with the core mold material.

The process for making manifold body 10A includes a lay-up process, a resin impregnation step, a curing step and a core mold drain step. The process laying up manifold body 10A shown in FIGS. 1A and 1B includes the following steps: (1) Structural fabric portions 132, 134, 136 and 138 are laid up around core mold 110. A spray adhesive may be used to force the structural fabric portions to adhere to the complex curved surfaces of core mold 110. (2) Core mold 110 with laid up fabric is placed between outside molds 102 and 104 which are then clamped tightly together. (3) Low viscosity resin is introduced into a resin entry port 104A in one of the outside molds. (4) In the case of a resin used in combination with carbon fiber fabric, a typical curing temperature would be about 130° F. An isothermal transfer process may be conducted where heated resin is transferred, via pressure or vacuum or a combination of pressure and vacuum, into a heated lay-up at the resin curing temperature. However, an isothermal transfer process must be conducted rapidly so that resin flows into the layers of the lay-up before it begins to harden.

After the resin is cured, outer molds 102 and 104 are separated from manifold body 10A. At this point, the core mold material can be melted and drained from manifold body 10A. This is accomplished by heating the manifold body to a temperature which is above the melting point of the core mold material but below the point at which the cured resin of manifold body 10A will degrade. The preferred wax composition described above can be melted efficiently at approximately 250° F. which is well below the temperature at which many resin resins will degrade. The melted core mold material can be recovered for future use. Core mold material residue can also be washed out with a solvent that will dissolve the core mold material but that will not attack the resin or carbon fiber material of the composite. What remains is a is an unfinished manifold body 10A having excess material. After appropriate trimming of the excess material from manifold body 10A, aluminum fittings 12B, 12C and 15A may be glued to manifold body 10A using a high strength adhesive, suitable for the application, thus completing intake manifold 10.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A method for making a composite air intake manifold body for an internal combustion engine, said manifold body having an inside surface and an outside surface defining a header and a plurality of runners communicating with said header wherein said header has an inlet opening for communication with an air supply and wherein each of said runners have an outlet port for passage of air into an air intake port of an internal combustion engine, said method for making said air intake manifold body comprising the steps of:

(a) selecting structural fiber cloth and a resin for impregnating said structural fiber cloth for making a composite material, said resin generally liquid when in an uncured condition and solid when in a cured condition, (b) fashioning a core mold from meltable material having an outside surface corresponding to said inside surface of said air intake manifold body, (c) fashioning at least two complementary outside mold portions having adjoining inside surfaces corresponding to said outside surface for said air intake manifold body, (d) covering said core mold with said structural fiber cloth to make a cloth lay-up, (e) enclosing said cloth lay-up within said outside mold portions, (f) injecting said resin into said cloth lay-up to make a resin impregnated lay-up, (g) allowing said resin of said resin impregnated lay-up to cure to make a cured lay-up, (h) removing said outside mold portions from said lay-up to expose a lightweight composite intake manifold shell, (i) heating said cured lay-up above the melting temperature of the core mold material causing said core mold material to melt and drain out of said cured lay-up.

2. The method of claim 1 wherein, said resin cures at an elevated resin curing temperature and degrades at a higher resin degradation temperature, wherein step (g) includes heating said lay-up to said elevated resin curing temperature to hasten curing and wherein said core mold material is adapted to melt at a temperature between said resin curing temperature and said resin degradation temperature so that in step (i) said cured lay-up is heated to a temperature above the melting temperature of said core mold material but below said resin degradation temperature to cause melting and removal of said core mold material.

3. The method of claim 1 wherein, said header of said intake manifold body is fashioned by overlaying alternating portions of structural fiber cloth impregnated with said resin and said runners of said intake manifold body are fashioned by overlaying woven tubes of structural fiber cloth at least one of which is also disposed in an overlapping relationship with said overlaid alternating portions of structural fiber cloth of said header.

4. The method of claim 1, wherein;

at least a portion of said structural fiber cloth is pre-impregnated structural fiber cloth which is pre-impregnated with resin so that it is not necessary to transfer resin into said pre-impregnated structural fiber cloth.

5. The method of claim 1 wherein, said structural fiber cloth is pre-impregnated with resin such that step (f) may be eliminated.

6. A method for making an air intake manifold for an internal combustion engine, said intake manifold including a body having an inside surface and an outside surface defining a header and a plurality of runners communicating with said header wherein said header has an inlet opening for communication with an air supply and each of said runners having an outlet port for passage of air into an air intake port of an internal combustion engine, said method for making said air intake manifold body comprising the steps of (a) selecting structural fiber cloth and a resin for impregnating said structural fiber cloth for making a composite material, said resin generally liquid when in an uncured condition and capable of curing at elevated curing temperature to a cured condition wherein said resin is a solid, (b) fashioning a core mold from meltable material having a melting point above the curing temperature of said resin, said core mold having an outside surface corresponding to said inside surface of said air intake manifold body, (c) obtaining at least two complementary outside mold portions having adjoining inside surfaces corresponding to a desired outside surface for said air intake manifold body, (d) covering said core mold with layers of said structural fiber cloth to make a cloth lay-up, (e) enclosing said cloth lay-up within said outside mold portions, (f) injecting said resin into said cloth lay-up to make a resin impregnated lay-up, (g) heating said resin impregnated lay-up to a curing temperature until said resin is cured to make a cured lay-up, (h) removing said outside mold portions from said cured lay-up to expose a lightweight composite intake manifold shell, (i) heating said cured lay-up above the melting temperature of the core mold material causing said core mold material to melt and drain out of said cured lay-up, (j) trimming the header of said manifold body to make an air inlet opening and trimming said runners to make a plurality of air outlet ports, (k) fashioning fittings for interfacing with air supply and engine air intake components and gluing said fittings to said manifold shell at said air inlet opening and said air outlet ports to make a completed air intake manifold.

7. The method of claim 6 wherein, said resin cures degrades at a higher resin degradation temperature substantially higher than said curing temperature and wherein said core mold material is adapted to melt at a temperature between said resin curing temperature and said resin degradation temperature so that in step (i) said cured lay-up is heated to a temperature above the melting temperature of said core mold material but below said resin degradation temperature.

8. The method of claim 6 wherein, said header of said intake manifold body is fashioned by overlaying alternating portions of structural fiber cloth impregnated with said resin and said runners of said intake manifold body is fashioned by overlaying woven tubes of structural fiber cloth at least one of which is also disposed in overlapping relationship with said overlaid alternating portions of structural fiber cloth of said header.

9. The method of claim 6, wherein;

at least a portion of said structural fiber cloth is pre-impregnated structural fiber cloth which is pre-impregnated with resin so that it is not necessary to transfer resin into said pre-impregnated structural fiber cloth.

10. The method of claim 6 wherein, said structural fiber cloth is pre-impregnated with resin such that step (f) may be eliminated.

11. An air intake manifold for an internal combustion engine, comprising:

a body including a header having an intake opening for receiving air and a plurality of runners pneumatically communicating with said header, said runners having distal outlet ports for discharging air to the intakes of an internal combustion engine, said header fashioned from overlaid alternating portions of structural fiber cloth impregnated with said resin and said runners fashioned from structural fiber cloth also impregnated with said resin and disposed in an overlapping relationship with said structural fiber cloth of said header, fittings fixed to said inlet opening of said header for connecting to the discharge of an air supply, and fittings fixed to said outlet ports of said runners for connecting to the air intakes of an internal combustion engine.

12. The air intake manifold of claim 11 wherein, said body of said intake manifold is a hollow lightweight shell.

13. The air intake manifold of claim 11 wherein, said body of said intake manifold is a hollow lightweight shell having internal passages having aerodynamically shaped walls which are smoothly blended to reduce the turbulence of air flow through said manifold.

14. The air intake manifold of claim 11 wherein, said runners of said intake manifold body are fashioned from woven tubes of structural fiber cloth.

* * * * *